US007175028B2

(12) United States Patent
Colgrove et al.

(10) Patent No.: US 7,175,028 B2
(45) Date of Patent: Feb. 13, 2007

(54) VIBRATORY SCREEN ASSEMBLIES

(75) Inventors: James R. Colgrove, Holland, NY (US); Gregory A. Kardach, Angola, NY (US)

(73) Assignee: Derrick Corporation, Buffalo, NY (US)

( * ) Notice: Subject to any disclaimer, the term of this patent is extended or adjusted under 35 U.S.C. 154(b) by 97 days.

(21) Appl. No.: 10/701,846

(22) Filed: Nov. 5, 2003

(65) Prior Publication Data

US 2005/0056571 A1 Mar. 17, 2005

Related U.S. Application Data

(63) Continuation-in-part of application No. 10/652,740, filed on Aug. 29, 2003, now Pat. No. 7,011,218.

(51) Int. Cl.
*B07B 1/49* (2006.01)

(52) U.S. Cl. ..... 209/409; 209/412; 209/405

(58) Field of Classification Search ..... 209/403, 209/404, 405, 408, 409, 412, 392, 393, 399; 29/527.3, 897.31, 897.312; 52/633, 648.1, 52/653.1

See application file for complete search history.

(56) References Cited

U.S. PATENT DOCUMENTS 4,473,466 A * 9/1984 Schmidt et al. ..... 209/397
4,476,466 A * 10/1984 Mitani et al. ..... 345/68
5,248,043 A * 9/1993 Dorn ..... 209/399
5,417,859 A * 5/1995 Bakula ..... 210/388
5,626,234 A 5/1997 Cook et al.
5,636,749 A * 6/1997 Wojciechowski ..... 209/403
5,927,511 A * 7/1999 Riddle et al. ..... 209/405
5,967,336 A * 10/1999 Baltzer et al. ..... 209/403
6,269,954 B1 * 8/2001 Baltzer ..... 209/405
6,708,829 B2 3/2004 Robertson et al.

FOREIGN PATENT DOCUMENTS

| | | |
|---|---|---|
| DE | 35 42 635 | 2/1987 |
| EP | 0 155 204 A2 | 9/1985 |
| FR | 2 407 026 | 5/1979 |
| GB | 2087265 | 5/1982 |
| GB | 2175222 | 11/1986 |

* cited by examiner

*Primary Examiner*—Patrick Mackey
*Assistant Examiner*—Kaitlin Joerger
(74) *Attorney, Agent, or Firm*—Kenyon & Kenyon LLP

(57) ABSTRACT

A screen assembly which includes a frame, a plurality of openings in the frame, a screen overlying the openings, a plurality of spaced tapered ribs on the opposite side of the frame from the screen, a first end on the frame with a lip, and a second end on the frame with a clip thereon. Another embodiment has a first end with a ledge and a second end with an overhanging portion, and a seal on the ledge.

19 Claims, 9 Drawing Sheets

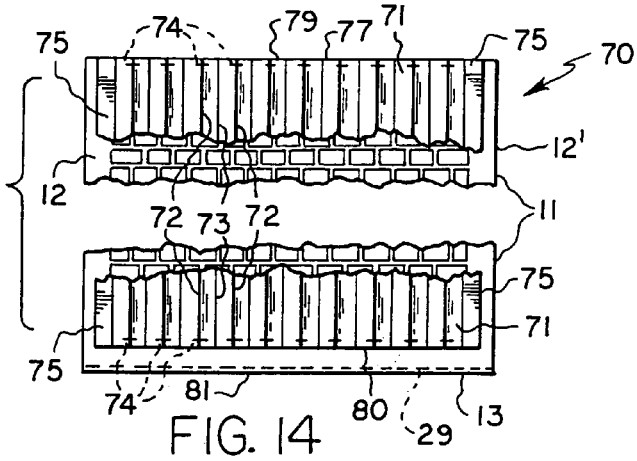
FIG. 14
FIG. 15
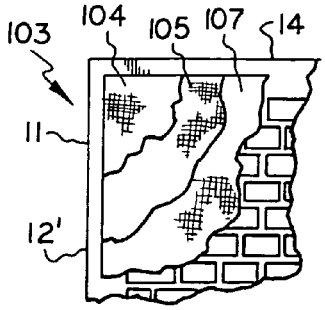
FIG. 16
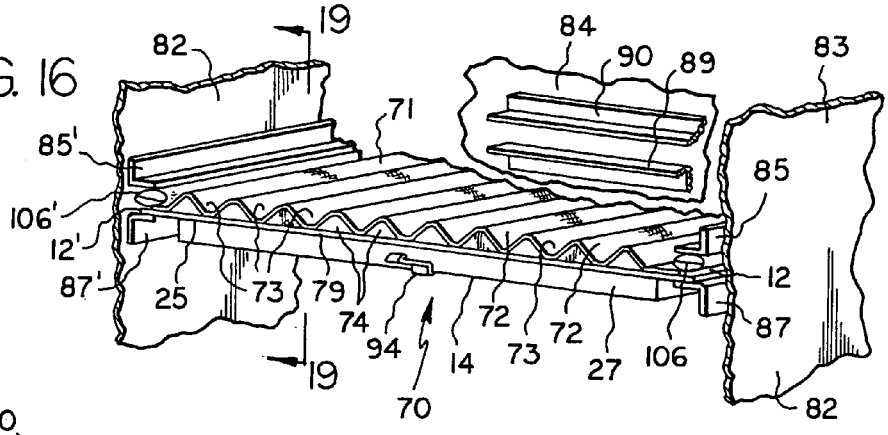
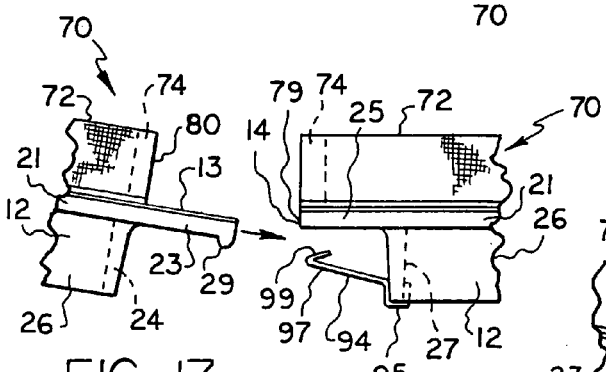
FIG. 17
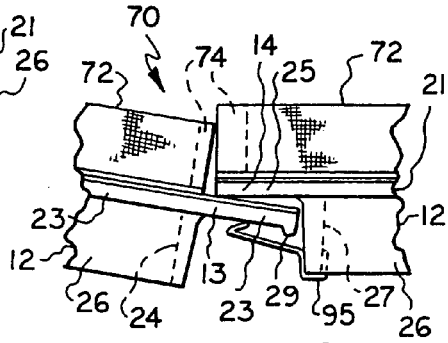
FIG. 18

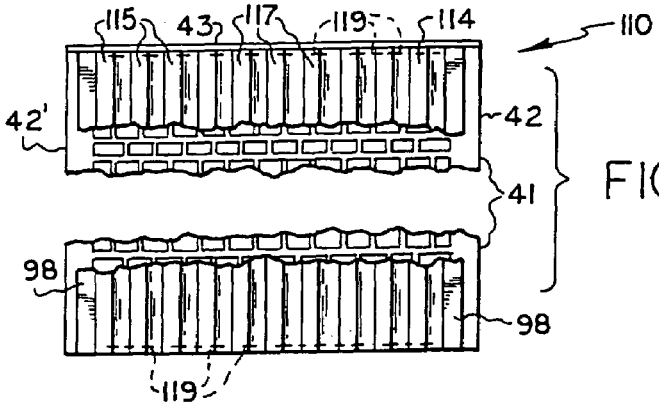
FIG. 22
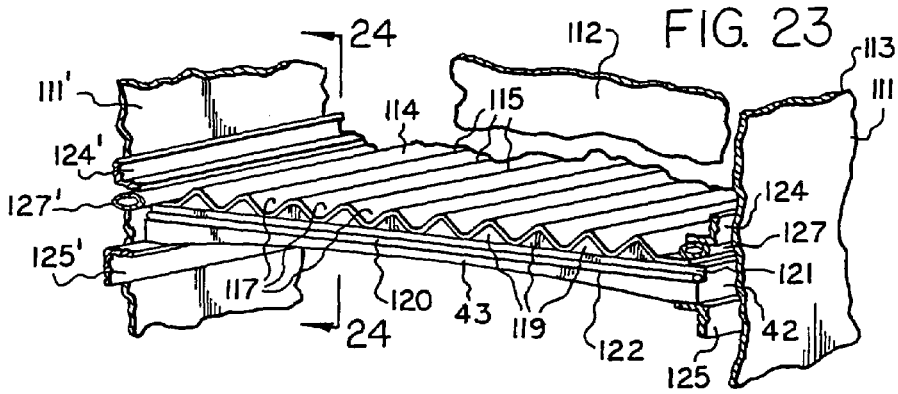
FIG. 23
FIG. 24
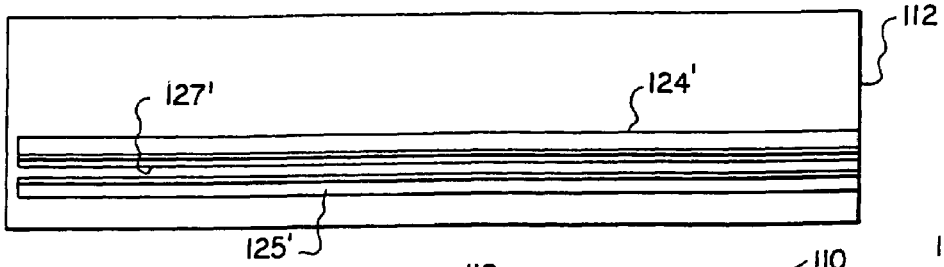
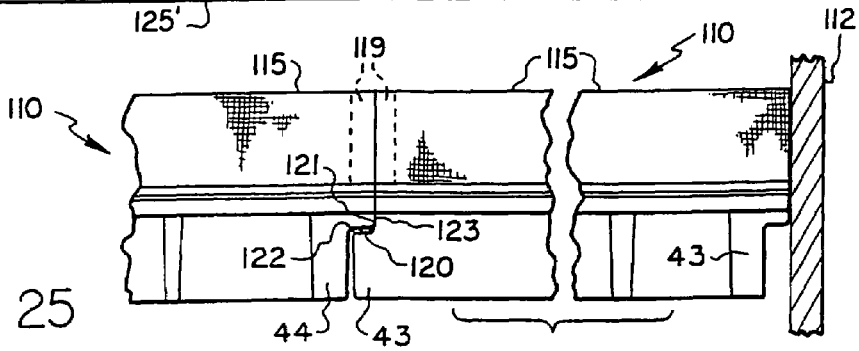
FIG. 25

VIBRATORY SCREEN ASSEMBLIES

CROSS-REFERENCE TO RELATED APPLICATIONS

The present application is a continuation-in-part of application Ser. No. 10/652,740, filed Aug. 29, 2003 now U.S. Pat. No. 7,011,218.

STATEMENT REGARDING FEDERALLY SPONSORED RESEARCH OR DEVELOPMENT

Not Applicable

BACKGROUND OF THE INVENTION

The present invention relates to improved screen assemblies for vibratory screening machines.

By way of background, there are in existence screen assemblies which include a rigid frame with a screen mounted thereon. However, these screens are relatively heavy in that they possess numerous ribs which are relatively closely spaced to each other. In addition, the ribs are of substantially rectangular cross section. Also, the side members of the screen are of uniform thickness throughout which also causes them to be relatively heavy. In addition, insofar as known, when two screens are mounted lengthwise on the vibratory frame of a vibratory screening machine, each screen has to be removed individually from the outlet end of the vibratory frame because there is no connection therebetween which would permit both screens to be pulled out together from the outlet of the vibratory frame. In addition, insofar as known other embodiments of vibratory screens which are placed end-to-end lengthwise in the vibratory frame do not have a simple effective seal therebetween which would prevent leakage at the joint between the two screens. It is with overcoming the foregoing deficiencies of the prior art that the present invention is concerned.

BRIEF SUMMARY OF THE INVENTION

It is accordingly one object of the present invention to provide a screen assembly which is of relatively light weight.

Another object of the present invention to provide an improved screen assembly wherein two like screen assemblies are joined to each other so that they can be pulled out together from the vibratory frame of a vibratory screening machine.

A further object of the present invention is to provide an improved screen assembly wherein two like screen assemblies can be mounted in end-to-end relationship in the vibratory frame of a vibratory screening machine with a simple effective seal therebetween. Other objects and attendant advantages of the present invention will readily be perceived hereafter.

The present invention relates to a screen assembly comprising a frame, first and second spaced side members on said frame, ends on said side members, upper and lower surfaces on said side members, first and second spaced end members on said frame at said ends of said side members, a plurality of spaced ribs extending between and joining said spaced side members, openings between said side members and said end members, a screen on said frame overlying said openings, and recessed indentations in said lower surfaces of said spaced side members.

The present invention also relates to a screen assembly comprising a frame, spaced side members on said frame, ends on said side members, first and second spaced end members on said frame at said ends of said side members, openings between said sides members and said first and second end members, a screen on said frame overlying said openings, a plurality of spaced ribs extending between and joining said spaced side members, upper edges on said ribs, and lower concave edges on said ribs.

The present invention also relates to a screen assembly comprising a frame, first and second spaced side members on said frame, ends on said side members, upper and lower surfaces on said side members, first and second spaced end members on said frame at said ends of said side members, a plurality of spaced ribs extending between and joining said spaced side members, openings between said side members and said end members, an undulating screen on said frame overlying said openings, said end members including upper end member surfaces and lower end member surfaces, and a lip extending outwardly from said lower end member surface of said first end member.

The present invention also relates to a screen assembly comprising a frame, first and second spaced side members on said frame, ends on said side members, upper and lower surfaces on said side members, first and second spaced end members on said frame at said ends of said side members, a plurality of spaced ribs extending between and joining said spaced side members, openings between said side members and said end members, a screen on said frame overlying said openings, an outwardly extending ledge on said first end member, and an overhanging portion on said second end member.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 14 is a fragmentary plan view of a screen assembly which includes the base of FIGS. 1–6 with an undulating screen thereon;

FIG. 15 is a fragmentary plan view of a screen assembly which includes the base of FIGS. 1–6 with a multi-layered flat screen thereon;

FIG. 16 is a fragmentary perspective view of the screen assembly of FIG. 14 mounted between the walls of the vibratory frame of a vibratory screening machine;

FIG. 17 is a fragmentary side elevational view of two screen assemblies of FIG. 14 as they are being mounted onto the vibratory screening machine of FIG. 16;

FIG. 18 is a fragmentary side elevational view similar to FIG. 17 but showing the two screen assemblies of FIG. 14 in the positions which they assume when they are fully mounted on the vibratory screening machine with the demounting latch fully assembled;

FIG. 22 is a fragmentary plan view of a vibratory screen assembly which has the base of FIGS. 8 and 9 and which has an undulating screen thereon;

FIG. 23 is a fragmentary perspective view showing the vibratory screen assembly of FIG. 22 mounted between the sides of the vibratory frame of a vibratory screening machine;

FIG. 24 is a side elevational view taken substantially in the direction of arrows 24—24 of FIG. 23 showing one side of the vibratory screening machine of FIG. 23 with angles mounted on the side wall for mounting the screen assembly of FIG. 22;

FIG. 25 is a fragmentary side elevational view showing the positions of two vibratory screening assemblies of FIG. 22 assembled in end-to-end relationship on the vibratory frame of FIG. 23;

DETAILED DESCRIPTION OF THE INVENTION

Figure 1:
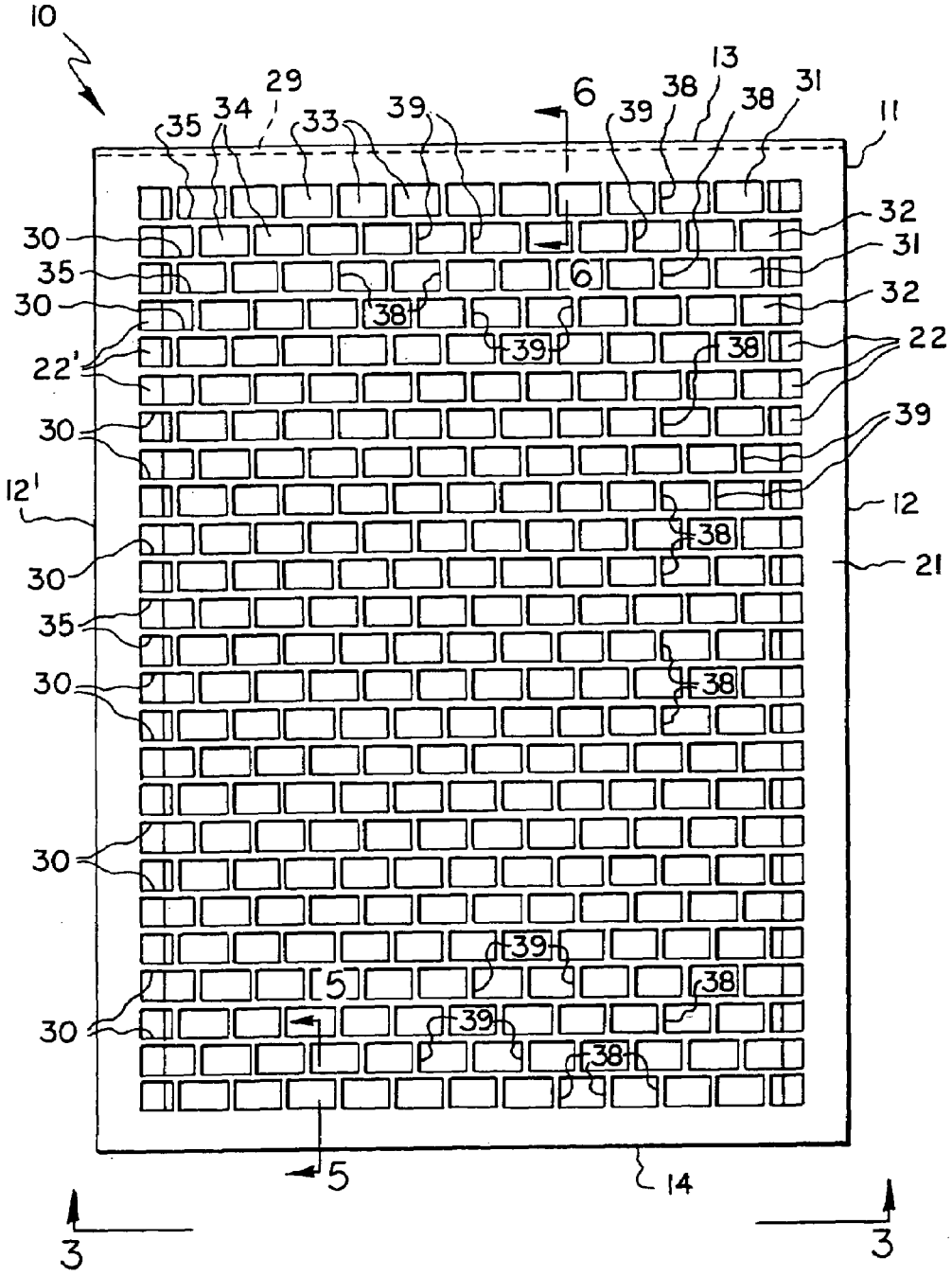
FIG. 1 is a top plan view of one embodiment of a screen supporting base.
Figure 2:
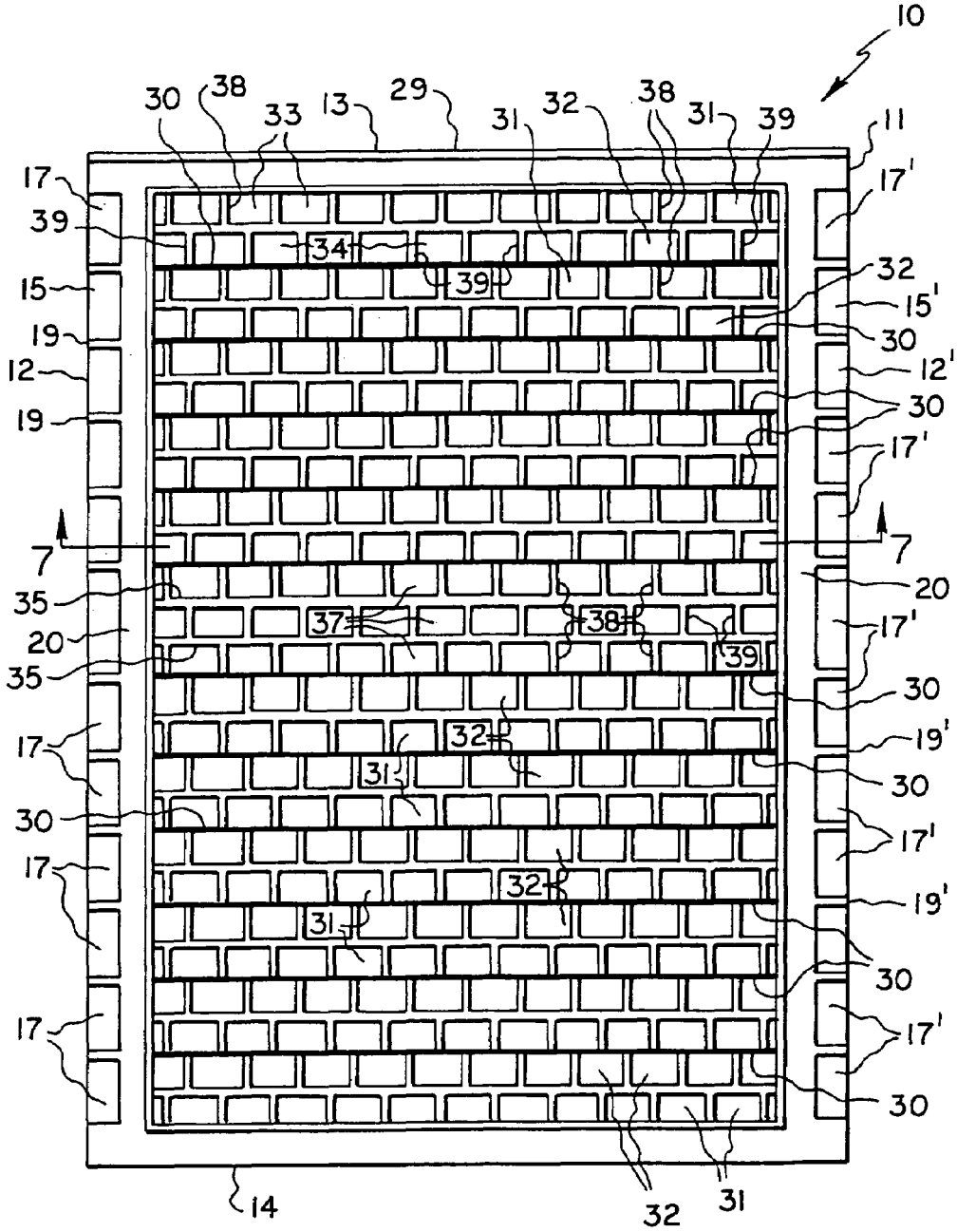
FIG. 2 is a bottom plan view of the screen supporting base of FIG. 1.
Figure 3:
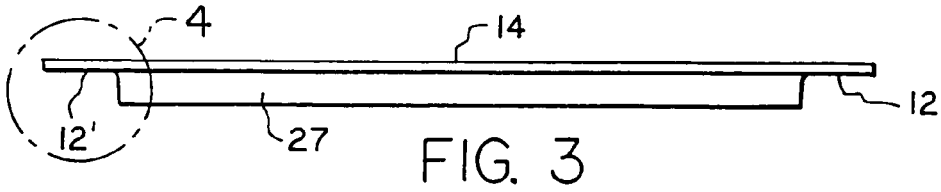
FIG. 3 is an end elevational view taken substantially in the direction of arrows 3—3 of FIG. 1.
Figure 4:
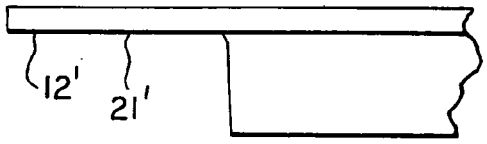
FIG. 4 is an enlarged detail view of the edge of the screen supporting base within the circled portion of FIG. 3.
Figure 6:
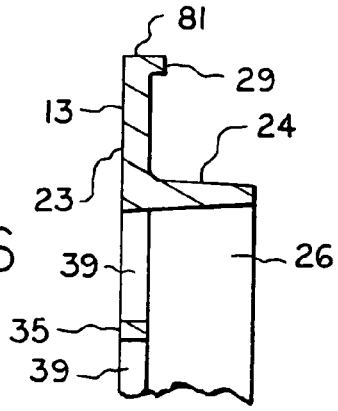
FIG. 6 is a fragmentary cross sectional view taken substantially along line 6—6 of FIG. 1.

By way of brief introductory summary, the screen supporting bases of FIGS. 1–7 and FIGS. 8–13 are lightweight and rigid. The lightweight aspect is due to a number of factors which include that they are made of cast aluminum and that they have relatively widely spaced ribs between the spaced side members of the frame and further because the spaced side members have recessed portions, and further yet because the various rib members are tapered. Also, one embodiment of the screens has a unique coupling arrangement for attaching two screens to each other. Another embodiment has a unique joint between two adjacent screens.

The screen supporting cast aluminum base 10 of FIGS. 1–7 includes an outer frame 11 which consists of mirror image side members 12 and 12' having ends which are cast integrally with end members 13 and 14. The undersides 15 and 15' of side members 12 and 12', respectively, have spaced recessed portions 17 and 17', respectively, extending throughout the lengths thereof which are separated by rib-like separators 19 and 19', respectively, which lie in the same plane as the adjacent surfaces 20 and 20', respectively, of the spaced side members 12 and 12', respectively. The recessed portions 17 serve two functions, namely, they reduce the weight of the base 10 and they are also instrumental in allowing the base 10 to be cast without warping.

The side members 12 and 12' are substantially in the shape of angles. Side member 12 has legs 21 and 26 with the recessed portions 17 being located in leg 21. Side member 12' has mirror image counterpart legs 21' and 26' with recessed portions 17' being located in leg 21'. Also, recessed portions 22 and 22' (FIGS. 1 and 7) are located in legs 21 and 21', respectively, to provide spaces underneath a screen structure which is attached to the top surface of the supporting base 10, as will be described in greater detail hereafter. A plurality of spaced ribs 30 (FIGS. 2 and 3) extend between and are molded integrally with side members 12 and 12' to provide strength to base 10 while providing relatively low weight. More specifically, ribs 30 extend between legs 26 and 26' (FIG. 7) of side members 17 and 17', respectively. Ribs 30 are designated by solid lines in FIG. 2 for ease of identification.

The end members 13 and 14 are cast integrally with side members 12 and 12'. End member 13 (FIG. 6) is in the shape of an angle having legs 23 and 24. End member 14 (FIG. 5) is also in the shape of an angle having legs 25 and 27. The only major difference between end members 13 and 14 is that leg 23 has a lip 29 which extends throughout the length of leg 23 for the purpose of attachment to an adjacent base 10 as will be described in greater detail hereafter.

Figure 5:
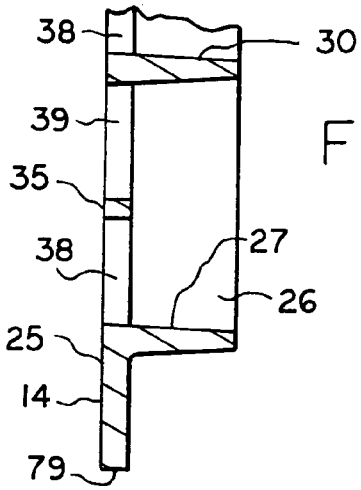
FIG. 5 is a fragmentary cross sectional view taken substantially along line 5—5 of FIG. 1.
Figure 7:
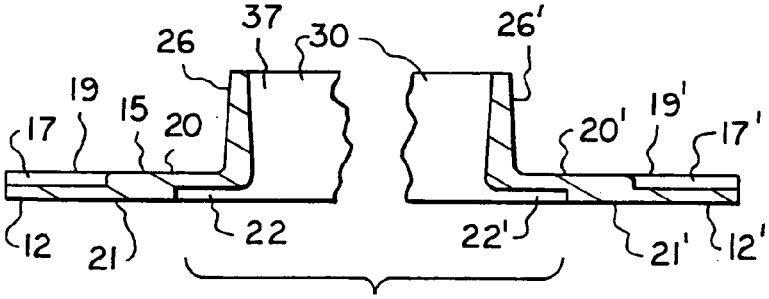
FIG. 7 is a fragmentary cross sectional view taken substantially along line 7—7 of FIG. 1.
Figure 8:
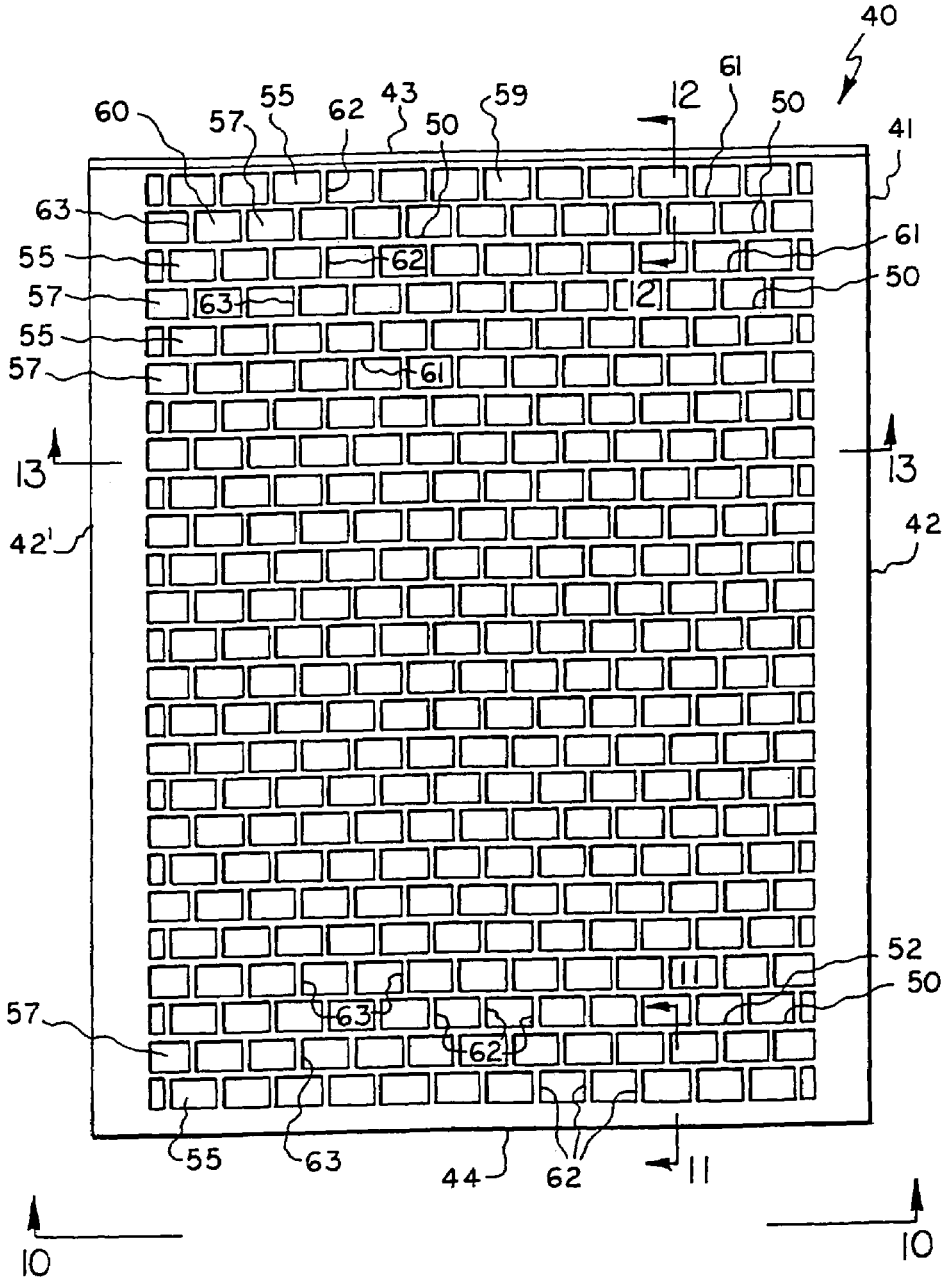
FIG. 8 is a top plan view of another embodiment of a screen supporting base.

The base 10 generally has alternate rows 31 and 32 of openings therein as shown in FIG. 1. Rows 31 have openings 33 therein and rows 32 have openings 34 therein. The openings are defined by border members. More specifically, the border members 35 are low-height strips which extend crosswise to side members 12 and 12' and are molded integrally therewith. The ribs 30 are also border members of the openings (FIG. 5). The openings 33 and 34 are further defined by border members 38 and 39 which extend crosswise to border members 35 and 30. Border members 38 are in rows 31 and border members 39 are in rows 32. Border members 38 extend in lines crosswise to end members 13 and 14, and border members 29 also extend in lines crosswise to end members 13 and 14. There are six pairs of rows 31 and 32 extending upwardly from end member 14 in FIG. 2 and there are five pairs of rows 31–32 extending downwardly from end member 13 in FIG. 2. At substantially the central portion of FIG. 2, there are three rows 37 wherein two border members 35 lie between two ribs 30. The uppermost and lowermost rows have border strips 38 and the central row 37 has border strips 39. As can be seen from FIGS. 5, 6 and 7, the legs 26 and 26' of side members 12 and 12', respectively, and the legs 24 and 27 of end members 13 and 14, respectively, are tapered to reduce weight. Also, border members 30 are tapered to reduce weight.

Figure 9:
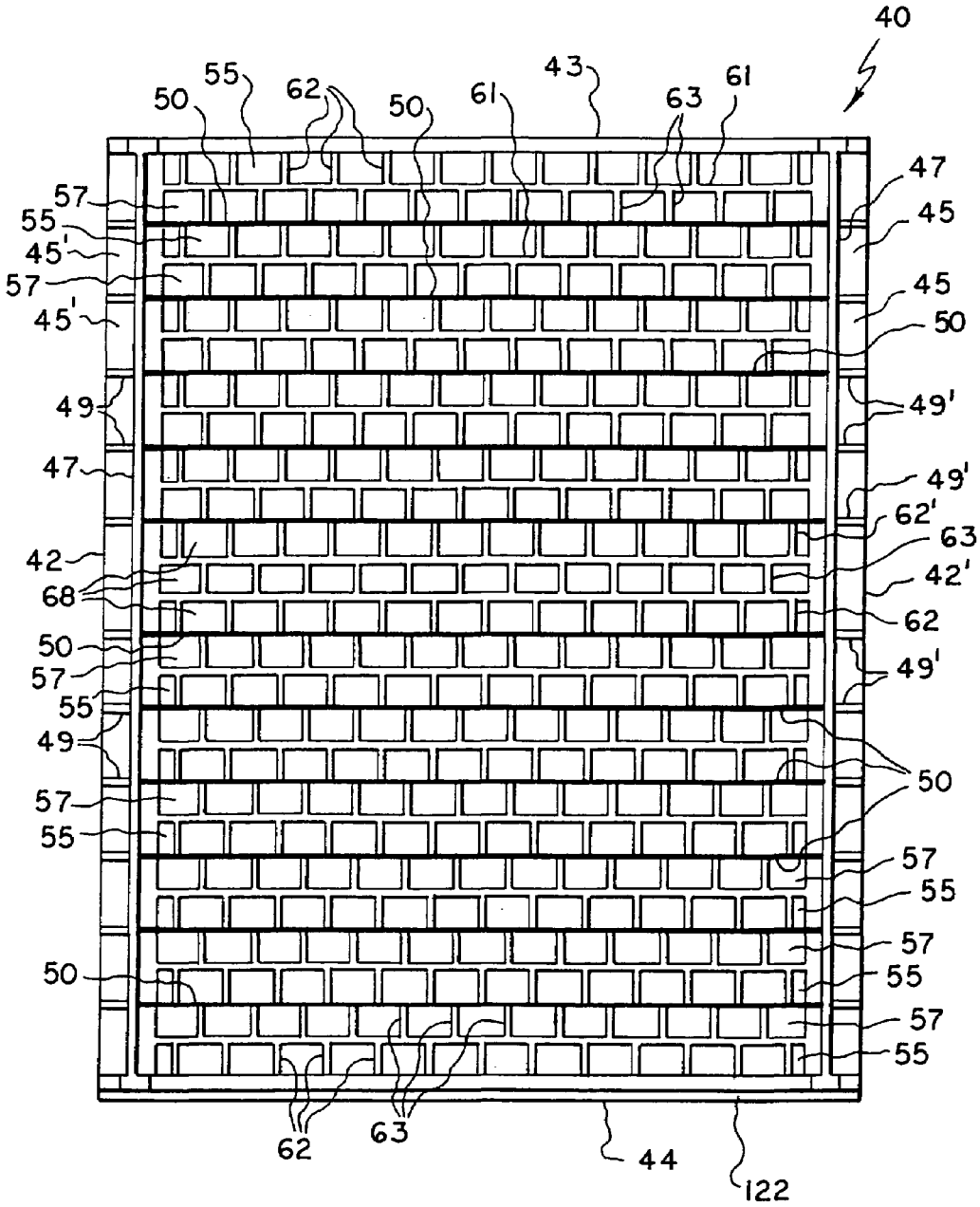
FIG. 9 is a bottom plan view of the screen supporting base of FIG. 8.
Figure 10:
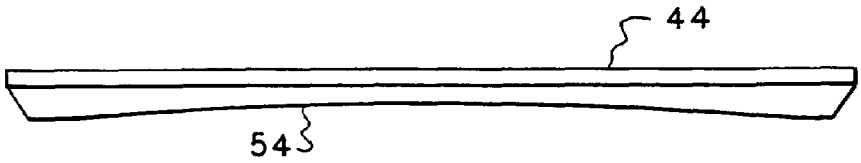
FIG. 10 is an end elevational view taken substantially in the direction of arrows 10—10 of FIG. 8.
Figure 11:
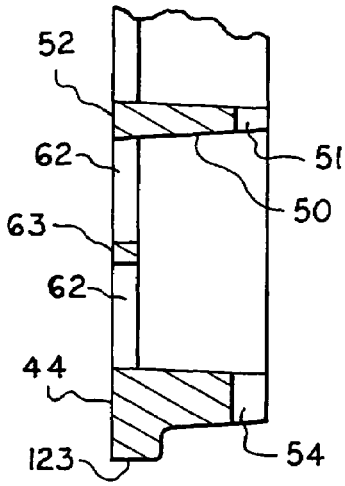
FIG. 11 is a fragmentary cross sectional view taken substantially along line 11—11 of FIG. 8.

In FIGS. 8–13 another embodiment of a cast aluminum screen supporting base is shown. Screen supporting base 40 includes a frame 41 having spaced side members 42 and 42' with spaced end members 43 and 44 cast integrally with the ends thereof. Side members 42 and 42' are essentially of T-shaped cross sectional configuration (FIG. 13) having a top portion 45 and a vertical portion 47. Side member 42' is a mirror image of side member 42 and it has a top portion 45' and a vertical portion 47'. Gussets 49 are located as shown in FIG. 9. Gussets 49' are mirror images of gussets 49. Ribs 50 are aligned with gussets 49 and 45' and they have their ends cast integrally with vertical portions 47 and 47' of T-shaped side members 42 and 42', respectively. Ribs 50 have a concave lower edge 51 and a straight upper edge 52. The lower edge of end member 43 is concave at 53 and the lower edge of end member 44 is concave at 54. The concave portion 51 of each rib 50 is of the same contour as concave portions 53 and 54 and all of the foregoing mentioned concave portions are aligned. The concavity of the edges 51, 53 and 54 reduces the weight of ribs 50 and end members 43 and 44, respectively, over the weight which they would have if these members were as high throughout their lengths as they are at their ends. Also, there is a weight lessening because the ribs 50 are tapered downwardly, as are vertical portions 47 of side members 42.

The base 40 has alternate rows 55 and 57 of openings 59 and 60, respectively. Generally, first sides of the openings 55 and 57 are bordered by ribs 50, which have been darkened in FIG. 9 for ease of identification. Second sides of the rows 55 and 57 are bordered by border members 61 which are of less height than ribs 50 and extend substantially parallel thereto and are cast integrally with side members 42 and 42' and extend crosswise thereto. The openings 55 and 57 are also bordered by border members 62 and 63, respectively, which extend perpendicularly to border members 50 and 61. Border members 62 are located in rows 55 and border members 63 are located in rows 57. Border members 62 of spaced rows 55 are aligned with each other in a direction crosswise of end members 43 and 44, and border members 63 of spaced rows 57 are aligned with each other in a direction crosswise of end members 43 and 44.

There are six pairs of rows 55 and 57 extending upwardly from end member 44 in FIG. 9 and there are five pairs of rows 55–57 extending downwardly from end member 43 in FIG. 9. At substantially the central portion of FIG. 9, there are three rows 68 wherein two border members 61 lie between two ribs 50. The uppermost and lowermost rows 68 have border strips 62 and the central row 63 has border strips 63.

In FIG. 14 a screen assembly 70 is shown wherein an undulating screen 71 is mounted on a frame 11 of FIGS. 1–7. The undulating screen 71 includes ridges 72 interspersed with valleys or troughs 73, as is well known in the art. The undulating screen is preferably of multi-layered construction wherein the various layers are secured to each other by a plastic grid, such as shown in U.S. Pat. No. 5,636,749 which is incorporated herein by reference. It will be appreciated that any other suitable undulating screen construction may be secured to the base 10. Both ends of the ridges 72 have molded caps or plugs 74 therein as disclosed in said U.S. Pat. No. 5,636,749. It will be appreciated that any other type of caps or plugs may be used. The outer longitudinal edges 75 of screen 71 are flat and are bonded to tops of side members 12 and 12'. Preferably they overlap side members 12 and 12' by approximately ¼ inch. The screen 71 is mounted on frame 11 with the end 77 flush with the very end 79 (FIG. 5) of end member 14. The opposite end 80 of screen 71 is spaced from the end 81 of end member 13. The undersides of valleys or troughs 73 are bonded to aligned border strips 38 within the two outermost border strips 38 and their ends are bonded to end members 13 and 14. The ridges 72 overlie aligned border strips 39. The screen borders 75 are also bonded to the outermost border strips 38. The screen assembly 70 weights approximately eighteen pounds.

Figure 20:
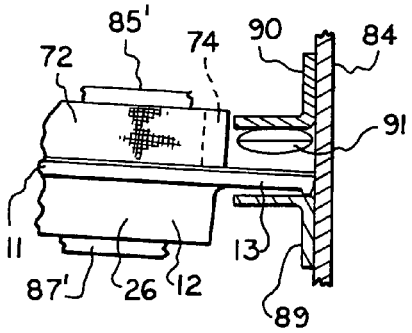
FIG. 20 is a view showing the vibratory screen of FIG. 14 in side elevation and showing the end wall of the vibratory screening machine in cross section with angles thereon for supporting the end of the vibratory screen assembly of FIG. 14 before the bladder is inflated.
Figure 21:
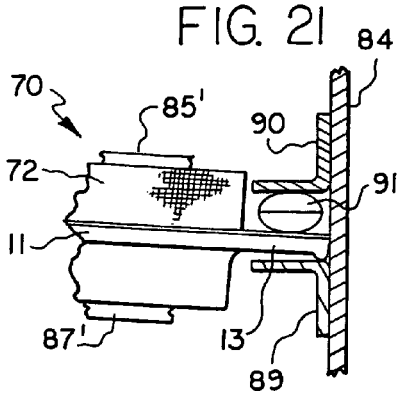
FIG. 21 is a view similar to FIG. 20 but showing the bladder inflated.

Two screen assemblies 70 are installed in end-to-end relationship between the side walls 82 of the vibratory frame 83 of a vibratory screening machine. The vibratory screening machine can be any conventional type wherein the vibratory frame 83 is resiliently mounted on an outer fixed frame and at least one vibratory motor is coupled to the vibratory frame to impart vibration thereto. A machine of this general type is shown in U.S. Pat. No. 5,332,101 which is incorporated herein by reference. The vibratory frame 83 also includes an end wall 84 between side walls 82 (FIGS. 16, 20 and 21).

Figure 19:
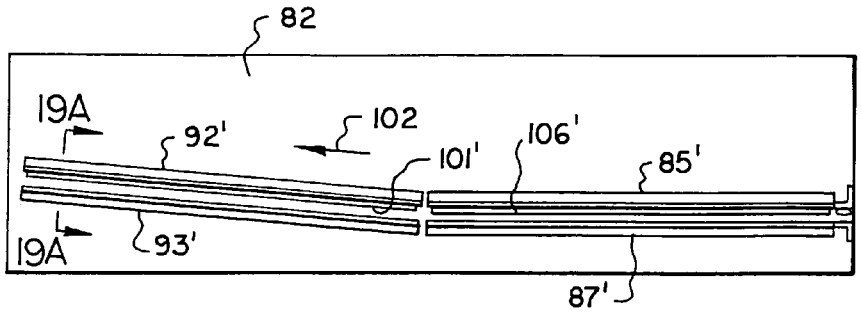
FIG. 19 is a side elevational view taken in the direction of arrows 19—19 of FIG. 16 and showing the angles which are mounted on one side and the end of the vibratory screening machine for mounting the undulating screen assemblies of FIG. 14.
Figure 19A:
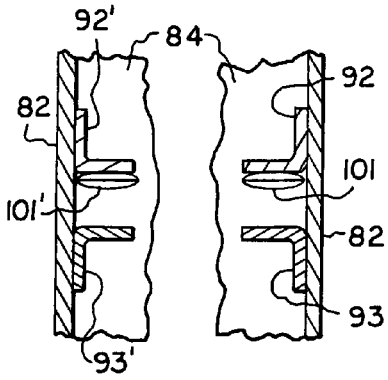
FIG. 19A is a fragmentary cross sectional view taken substantially along line 19A—19A of FIG. 19 and showing both sides of the vibratory frame.

As noted above, two screen assemblies 70 are installed in end-to-end relationship between the side walls 82 of the vibratory frame 83. One of the screen assemblies 70 is initially installed proximate end wall 84 by simultaneously sliding one side between the two angles 85' and 87' and the opposite side between angles 85 and 87 until the end member 13 of frame 11 reaches the position of FIG. 20 between angles 89 and 90. The second screen assembly 70 is thereafter installed by simultaneously sliding one side between angles 92' and 93' on one side wall 82 and the opposite side between counterpart mirror-image angles 92 and 93 on the opposite side wall 82 (FIG. 19A). As can be seen from FIG. 19, the angles 92' and 93' are positioned at an angle relative to angles 85' and 87', and the same is true of angles 92 and 93 and angles 85 and 87.

During the installation of the two screen assemblies, as can be seen from FIGS. 17 and 18, the vibratory screen assembly 70 at the left of these figures will come in at an angle relative to the previously installed screen assembly 70 which is on the right. A spring clip 94 has an end 95 which is secured to vertical leg 27 of end member 14. A central portion 97 of clip 94 extends as shown in FIGS. 17 and 18. The end of the clip 94 is bent upwardly as shown at 99. As the screen assembly 70 is slid between the angles 92'–93' and angles 92–93 in the direction shown by the arrow in FIG. 17, the lip 29 will engage the bent-over end 99 of spring clip 94 and cause central portion 97 to pivot counterclockwise until lip 29 passes over bent-over portion 99. Thereafter, the screen assembly 70 on the left will continue to move until the ends of ridges 72 of adjacent screen assemblies 70 abut each other, as shown in FIG. 18. It will be appreciated that the ridges 72 of the adjoining screen assemblies 70 will be in alignment, as will be the grooves or valleys 73 therebetween. As can be seen from FIG. 18, the corner edge of end member 14 will engage the upper surface of end member 13 to effectively produce a sealing arrangement therebetween. The screen assembly 103 of FIG. 15 also functions in the same manner as screen assembly 70 except for the absence of the undulating screens.

Suitable structure is provided on the vibratory frame 83 for clamping the two screen assemblies in position and sealing them against leakage. In this respect, elongated bladder 101' (FIG. 19A) is secured to the underside of the horizontal leg of angle 92' and elongated bladder 101 is secured to the underside of the horizontal leg of angle 92. Also, an elongated bladder 106' (FIG. 16) is secured to the underside of the horizontal leg of angle 85' and a counterpart elongated bladder 106 is secured to the underside of the horizontal leg of angle 85. The end member 13 (FIG. 20) of the initially installed screen assembly 70 rests on the horizontal leg of angle 89 secured to end wall 84 and it is located below the horizontal leg of angle 90 which is also secured to end wall 84. An elongated bladder 91 is fixed to the underside of the horizontal leg of angle 90. Suitable structure (not shown) is provided for inflating all of the above bladders to thereby firmly clamp in position end member 13 of the initially installed screen assembly 70 and the sides of both screen assemblies 70. All of the bladders act as seals to prevent material which is applied to the screen assemblies 70 from leaking past them.

When it is desired to remove the two end-to-end screen assemblies 70 from between the vibratory frame walls 82, the various above-described bladders are deflated, and the end vibratory screen assembly 70, which is located between angles 92–93 and 92'–93' is pulled in the direction of arrow 102 (FIG. 19), and the bent-over tip 99 of spring clip 94 will be engaged by lip 29 so that as the screen assembly 70 remote from end wall 84 is being moved in the direction of arrow 102, the screen assembly which is located between channels 85–87 and 85'–87' will be pulled along the channels in which it is located, and the side edges 12 and 12' of frame 11 will enter the spaces between channels 92–93 and channels 92'–93' and will continue to be pulled until it can be removed from between side walls 82.

In FIG. 15 a screen assembly 103 is shown which is mounted on a frame 11 described above relative to FIGS. 1–7. The screen assembly 103 differs from the screen assembly 70 in that it has a multi-layered flat screen bonded to frame 11 rather than the undulating screen 71. The multi-layered flat screen consists of an upper layer 104 of fine screening material and intermediate layer 105 of coarser screening material and a lowest layer 107 of supporting screen material. Screens of this type are well known in the art. Any other suitable flat screen can be bonded to frame 11. The screen assembly weighs approximately eighteen pounds and is approximately 32 inches long and 25 inches wide.

The undulating screen 71 is bonded to the top surface of frame 11 in the following manner. The entire frame is coated with a fused polypropylene powder known under the trademark of TALISMAN 3DES Electrostatic Black 700. The powder covers the surface of the frame 11 and, as noted, it is heated by the application of suitable heat to form a coating which is allowed to cool. Thereafter, a screen 71 is positioned over the frame 11, as shown in FIG. 14, and heat and pressure are applied thereto to activate the coating and cause it to act as an adhesive to seal the undersides of troughs 73 lengthwise of strips 38 and crosswise to the tops of ribs 30 and members 35 where strips 38 join ribs 30 and cross members 35. Also the sides 75 of the undulating screen are bonded to the sides 12 and 12' of frame 11 by the above-described adhesive. The flat multi-screen of FIG. 15 is secured to the top surface of frame 11 by suitable epoxy which has been applied in powder form to the frame 11. This epoxy is known as green screen epoxy and is product E-1227 of Sundur Powder Coatings of St. Louis, Mo.

In FIGS. 22–25 a screen assembly 110 is shown and the manner in which it is mounted between the side walls ill and 111' and the end wall 112 of the vibratory frame 113 of a vibratory screening machine. The vibratory screen assembly 110 includes a frame 41 (FIGS. 8 and 9) which is described in detail above in FIGS. 8–13. It also includes an undulating screen 114 which is substantially identical to undulating screen 71 described above. It has ridges 115 interspersed with troughs 117. The ends of the ridges all have caps or plugs 119 therein. As noted above, the undulating screen 114 may be of the same type as undulating screen 71 described above relative to FIGS. 14–21.

The undulating screen 114 is bonded to frame 41 in the same manner as described above relative to undulating screen 71 and frame 11. More specifically, the undersides of troughs 117 are bonded to border strips 62 which extend crosswise to end members 43 and 44. The ends of the undulating screen are bonded to end members 43 and 44, and the sides 98 of screen 114 are bonded to frame sides 41 and 41'. Also, while not shown, a flat screen can also be bonded to the top of frame 41 in the same manner as described above relative to FIG. 15. The screen assembly 110 weights approximately nineteen pounds, and a screen assembly with a flat screen also weighs approximately nineteen pounds and both are approximately 34 inches long and 27 inches wide.

Figure 12:
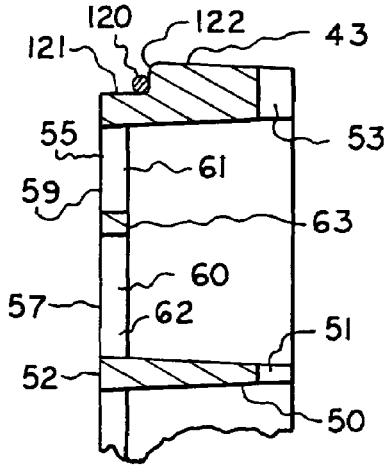
FIG. 12 is a fragmentary cross sectional view taken substantially along line 12—12 of FIG. 8.
Figure 13:
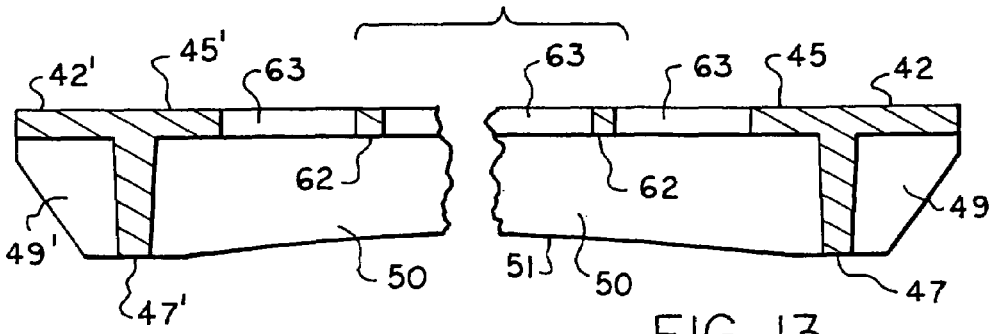
FIG. 13 is a fragmentary cross sectional view taken substantially along line 13—13 of FIG. 8.

Two screen assemblies 110 are mounted in end-to-end relationship between the sides 111 and 111' of the vibratory frame 113 of the vibratory screening machine. The ridges 115 and grooves 117 of the end-to-end screen assemblies 110 are aligned and in abutting relationship as shown in FIG. 25. An elongated seal 120 is located at the junction of sides 121 and 122 of end member 43 (FIGS. 23 and 12). Side 122 of end member 43 (FIGS. 9, 12 and 25) is a ledge which receives overhang 123 (FIG. 11) of end member 44. The seal 120 is an elongated bead-like structure which can be a suitable elastomeric member (FIGS. 12, 23 and 25).

The two end-to-end screen assemblies 110 each have side members 42 and 42' which are received between angles 124 and 125 on side wall 11 and mirror-image angles 124' and 125' on side wall 111'. Bladders 127 and 127' are secured to the undersides of the horizontal legs of angles 124 and 124' to press down on edge portions 42 and 42' of frame 41 when they are inflated to thereby firmly hold them in position and seal them against leakage. The bladders 127 and 127' occupy the entire lengths of angles 124 and 124', and the ends of angles 124 and 124 abut end wall 112. Also, when installed the end of the screen assembly 110 which is adjacent to end wall 112 actually abuts the end wall, as shown in FIG. 25. If desired a seal member can be mounted on wall 112 so that the end of the screen assembly will abut the seal.

Figure 26:
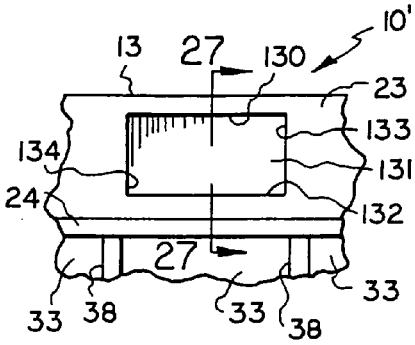
FIG. 26 is a fragmentary plan view of another embodiment of a screen base having a different lip attachment structure.
Figure 27:
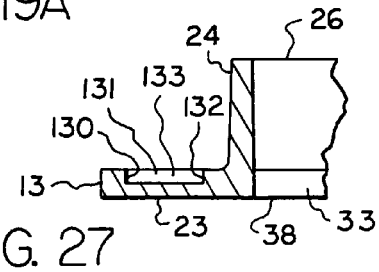
FIG. 27 is a fragmentary cross sectional view taken substantially along line 27—27 of FIG. 26.

In FIG. 26 and 27 a fragmentary view of another screen base embodiment 10' is shown. This embodiment is identical in practically all respects to the embodiment 10 of FIGS. 1 and 2 and identical numerals represent identical elements of structure. The only difference is in the lip structure in end member 13. The elongated lip 29 of FIGS. 1 and 2 has been eliminated in favor of a lip 130 which is part of a rectangular depression 131 having sides 132, 133 and 134. Lip 130 functions in the same manner as lip 29 as shown in FIGS. 17 and 18. In this respect, spring clip 94 will enter rectangular depression 131 when two screen bases 10' are assembled, and when the bases are withdrawn, the hook end of clip 94 will engage lip 130 to pull the screen base 10' having the clip 94 thereon along with the screen base having the lip 130 thereon.

The vibratory screening machine referred to above is a prior art device, and its only relationship to the screen structures is to show the manner in which the screen structures of the present invention are installed therein.

While preferred embodiments of the present invention have been disclosed, it will be appreciated that it is not limited thereto but may be otherwise embodied within the scope of the following claims.

The invention claimed is:

1. A screen assembly comprising a frame, first and second spaced side members on said frame, ends on said side members, upper and lower surfaces on said side members, first and second spaced end members on said frame at said ends of said side members, a plurality of spaced ribs extending between and joining said spaced side members, openings between said side members and said end members, a screen on said frame overlying said openings, and recessed indentations in said lower surfaces of said spaced side members wherein said screen includes undulations having ridges and valleys which extend longitudinally of said first and second side members wherein said openings are oriented in rows extending crosswise of said side members wherein a plurality of rows of openings are located between at least certain of said ribs wherein said end members include upper end member surfaces and lower end member services, and a lip on said lower end member surface of said first end member wherein said lip is part of a depression in said lower end member surface.

2. A screen assembly comprising a frame, spaced side end members on said frame, ends of said side members, first and second spaced end members at said frame at said ends of said side members, openings between said side members and said first and second end members recessed indentations in lower surfaces of said spaced side end members, a screen on said frame overlying said openings, a plurality of spaced ribs extending between and joining said spaced side members, upper edges on said ribs, and lower concave edges on said ribs wherein said openings are oriented in rows extending crosswise of said side members wherein a plurality of rows of openings are located between at least certain grids.

3. A screen assembly as set forth in claim 2 wherein said ribs are tapered away from said screen.

4. A screen assembly comprising a frame, first and second side members on said frame, ends on said side members, upper and lower surfaces on said side members, first and second spaced end members on said frame at said ends of said side members, a plurality of spaced ribs extending between and joining said spaced side members, openings between said side members and said end members, an undulating screen on said frame overlying said openings, said end members including upper end member surfaces and lower end member surfaces, and a lip on said lower end member surface of said first end member wherein said lip is part of a depression in said lower end member surface wherein said ribs are tapered away from said screen.

5. The screen assembly as set forth in claim 4 including a clip on said second end member.

6. The screen assembly as set forth in claim 4 wherein said lip is part of a depression in said lower end member surface.

7. A screen assembly as set forth in claim 6 including a clip on said second end member.

8. A screen assembly as set forth in claim 4 wherein said undulations have first undulation ends and second undulation ends, and wherein said first end member extends outwardly beyond said first undulation ends.

9. A screen assembly as set forth in claim 8 including a clip on said second end member.

10. A screen assembly as set forth in claim 8 wherein said lip is part of a depression in said lower end member surfaces.

11. A screen assembly as set forth in claim 10 including a clip on said second end member.

12. A screen assembly as set forth in claim 8 wherein second end member has an outer end, and said second undulation end terminates substantially evenly with said outer end of said second end member.

13. A screen assembly as set forth in claim 12 including a clip on said second end member.

14. A screen assembly as set forth in claim 12 wherein said lip is part of a depression in said lower end member surface.

15. The screen assembly as set forth in claim 14 including a clip on a said second end member.

16. A screen assembly comprising a frame, first and second spaced side members on said frame, ends on said side members, upper and lower surfaces on said side members, first and second spaced end members on said frame at said ends of said side members, a plurality of spaced ribs extending between and joining said spaced side members, openings between said side members and said end members, a screen on the said frame overlying said openings, an outwardly extending ledge on said first end member, and an overhanging portion on said second end member wherein said ribs are tapered away from said screen.

17. A screen assembly as set forth in claim 16 including a junction between said ledge and an adjoining portion of the said first end member, and a seal located at said junction.

18. A screen assembly as set forth in claim 17 wherein said openings are oriented in rows extending crosswise of said side members.

19. A screen assembly as set forth in claim 18 wherein a plurality of rows of openings are located between at least certain of said ribs.

* * * * *